US012298029B2

(12) United States Patent
Guan et al.

(10) Patent No.: US 12,298,029 B2
(45) Date of Patent: May 13, 2025

(54) DOUBLE-SIDED UNIFORM AIR DISCHARGE CEILING CASSETTE

(71) Applicant: Guangdong Giwee Technology Co. Ltd., Foshan (CN)

(72) Inventors: Hong Guan, Foshan (CN); Yuxian Wang, Foshan (CN)

(73) Assignee: GUANGDONG GIWEE TECHNOLOGY CO. LTD., Foshan (CN)

( * ) Notice: Subject to any disclaimer, the term of this patent is extended or adjusted under 35 U.S.C. 154(b) by 413 days.

(21) Appl. No.: 17/889,533

(22) Filed: Aug. 17, 2022

(65) Prior Publication Data

US 2023/0054689 A1 Feb. 23, 2023

(30) Foreign Application Priority Data

Aug. 17, 2021 (CN) ..... 202121921963.7

(51) Int. Cl.

| | |
|---|---|
| ***F24F 1/0047*** | (2019.01) |
| ***F24F 1/0014*** | (2019.01) |
| ***F24F 1/0022*** | (2019.01) |
| ***F24F 13/14*** | (2006.01) |

(52) U.S. Cl.

CPC ..... *F24F 13/14* (2013.01); *F24F 1/0014* (2013.01); *F24F 1/0022* (2013.01); *F24F 1/0047* (2019.02)

(58) Field of Classification Search

CPC ..... F24F 1/0014; F24F 1/0022; F24F 1/0047; F24F 13/08

See application file for complete search history.

(56) References Cited

U.S. PATENT DOCUMENTS 1,872,785 A * 8/1932 Modine ..... F28D 1/024 165/125
3,978,919 A * 9/1976 Fachbach ..... F01P 11/12 165/125

(Continued)

FOREIGN PATENT DOCUMENTS

| | | |
|---|---|---|
| CN | 106287968 A | 1/2017 |
| CN | 108087974 A | 5/2018 |
| CN | 108488909 A | 9/2018 |

(Continued)

OTHER PUBLICATIONS

European Search Report for Application No. 22190869.2, Issued Dec. 13, 2022, 7 Pages.

*Primary Examiner* — Allen R. B. Schult
(74) *Attorney, Agent, or Firm* — CANTOR COLBURN LLP

(57) ABSTRACT

A double-sided uniform air discharge ceiling cassette, including a case, and a centrifugal fan wheel, a first heat exchanger, and a second heat exchanger which are mounted within the case, the first heat exchanger and the second heat exchanger respectively forming an air discharge duct with two inner side walls of the case, the centrifugal fan wheel being located between the first heat exchanger and the second heat exchanger, and an air outlet of the centrifugal fan wheel facing an inner top face of the case, the inner top face of the case is provided with a flow guide plate, the flow guide plate is of a V-shaped structure with an included angle, and the included angle of the flow guide plate faces the air outlet of the centrifugal fan wheel.

10 Claims, 3 Drawing Sheets

(56) References Cited

U.S. PATENT DOCUMENTS 6,802,361 B2 * 10/2004 Hatanaka ..... F24F 1/0047
165/53
2021/0010686 A1 1/2021 Noguchi

FOREIGN PATENT DOCUMENTS

DE 102011102343 A1 * 11/2012 ..... B60H 1/00364
JP S60135522 A 7/1985

* cited by examiner

DOUBLE-SIDED UNIFORM AIR DISCHARGE CEILING CASSETTE

FOREIGN PRIORITY

This application claims priority to Chinese Patent Application No. 2021219219637, filed Aug. 17, 2021, and all the benefits accruing therefrom under 35 U.S.C. § 119, the contents of which in its entirety are herein incorporated by reference.

TECHNICAL FIELD OF INVENTION

The present application relates to the technical field of ceiling cassette structures, and particularly to a double-sided uniform air discharge ceiling cassette.

BACKGROUND OF THE INVENTION

Existing double-sided air discharge ceiling cassettes are restricted by the air discharge characteristics of a forward centrifugal fan wheel and the placement position of a fan, resulting in a large difference between the air volumes of air outlets on two sides thereof, and poor wind speed distribution on the surfaces of heat exchangers on the two sides. The specific problems are: 1) a large difference between the air discharge volumes on two sides of the double-sided air discharge ceiling cassette; 2) non-uniform wind speed distribution on the surfaces of heat exchangers on the two sides of the double-sided air discharge ceiling cassette; and 3) a small total air volume of the double-sided air discharge ceiling cassette. The technical reasons for the above problems are as follows:

1) Due to being restricted by the air discharge characteristics of the forward centrifugal fan wheel and the mounting position of the centrifugal fan, the air discharge of the centrifugal fan is greatly affected by the static pressure, resulting in non-uniform flow inside a case and a large difference between the air volumes of air outlets on two sides.
2) Due to the mounting position of the centrifugal fan, the distance between the air outlet and the case is small, resulting in a poor flow state within the case, and the wind speed on the lower side of the case is relatively large, resulting in poor wind speed distribution uniformity of the air flowing through the surface of the heat exchanger.
3) Due to being restricted by the mounting position of the centrifugal fan, the distance between the air outlet and the case is small, which causes the air discharge to be greatly affected by the resistance, resulting in a small total air volume.

SUMMARY OF THE INVENTION

An objective of the present application is to overcome the deficiencies in the prior art, and to provide a double-sided uniform air discharge ceiling cassette, which has the characteristics of uniform air discharge.

In order to achieve above objective, a double-sided uniform air discharge ceiling cassette provided by the present application comprises a case, and a centrifugal fan wheel, a first heat exchanger, and a second heat exchanger which are mounted within the case, the first heat exchanger and the second heat exchanger respectively forming an air discharge duct with two inner side walls of the case, the centrifugal fan wheel being located between the first heat exchanger and the second heat exchanger, and an air outlet of the centrifugal fan wheel facing an inner top face of the case, wherein the inner top face of the case is provided with a flow guide plate, wherein the flow guide plate is of a V-shaped structure with an included angle, and the included angle of the flow guide plate faces the air outlet of the centrifugal fan wheel.

Further, a length direction of the flow guide plate is arranged inclined to an axial direction of the centrifugal fan wheel on a horizontal plane based on the inner top face of the case.

Further, an included angle between the length direction of the flow guide plate and the axial direction of the centrifugal fan wheel is 5° to 20°.

Further, the included angle of the flow guide plate is 80° to 100°.

Further, the flow guide plate is composed of a first flow guide portion and a second flow guide portion that are arranged in a V shape, the first flow guide portion and the second flow guide portion being respectively adjacent to the first heat exchanger and the second heat exchanger, wherein an included angle A is formed between the first flow guide portion and the inner top face of the case, an included angle B is formed between the second flow guide portion and the inner top face of the case, and the included angle A and the included angle B are sized in direct proportion to distances from the air outlet of the centrifugal fan wheel to the first heat exchanger and the second heat exchanger.

Further, the first flow guide portion and the second flow guide portion have the same width.

Further, a plate surface of the flow guide plate is provided with a number of uniformly arranged flow guide holes.

Further, a flow guide portion is formed at an outer edge of each of the flow guide holes, and the flow guide portion is of a flange structure extending outwardly in an arc shape.

Further, each of the flow guide holes is in the shape of an elongated hole.

Further, an opening between the flow guide portion and the outer edge of the flow guide hole is capable of being arranged upward or downward.

The present application adopts above solutions and has the following beneficial effects: with the provision of a flow guide plate, the air discharge volumes from the two sides can both account for about 50%, the total air volume is also increased, and air discharge and heat exchange are more uniform.

In the figures, 1—case, 11—air discharge duct, 2—first heat exchanger, 3—second heat exchanger, 4—centrifugal fan wheel, 5—flow guide plate, 51—first flow guide portion, 52—second flow guide portion, 53—flow guide hole, and 54—flow guide portion.

DETAILED DESCRIPTION OF THE INVENTION

In order to facilitate understanding of the present application, the present application is described more fully below with reference to the accompanying drawings. Preferred embodiments of the present application are shown in the accompanying drawings. However, the present application may be implemented in many different forms and is not limited to the embodiments described herein. These embodiments are provided for a purpose of providing a more thorough understanding of the disclosure of the present application.

Figure 1:
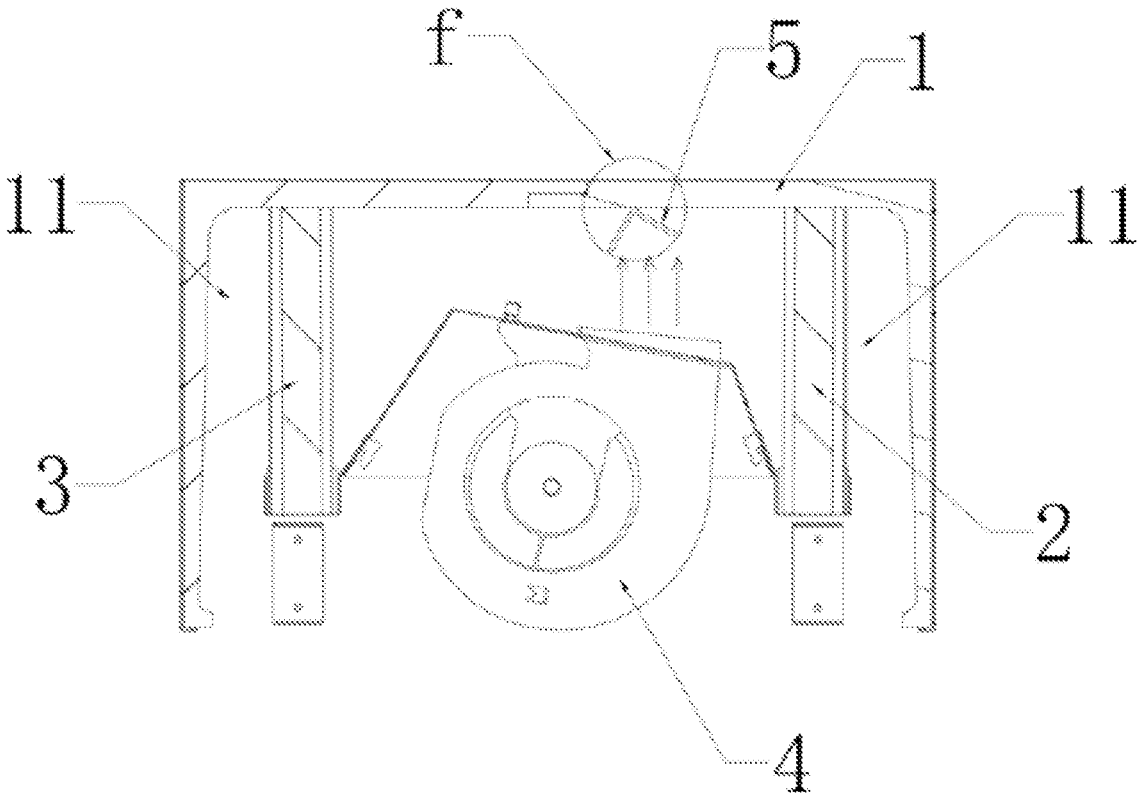
FIG. 1 is a structural schematic diagram of a ceiling cassette.
Figure 2:
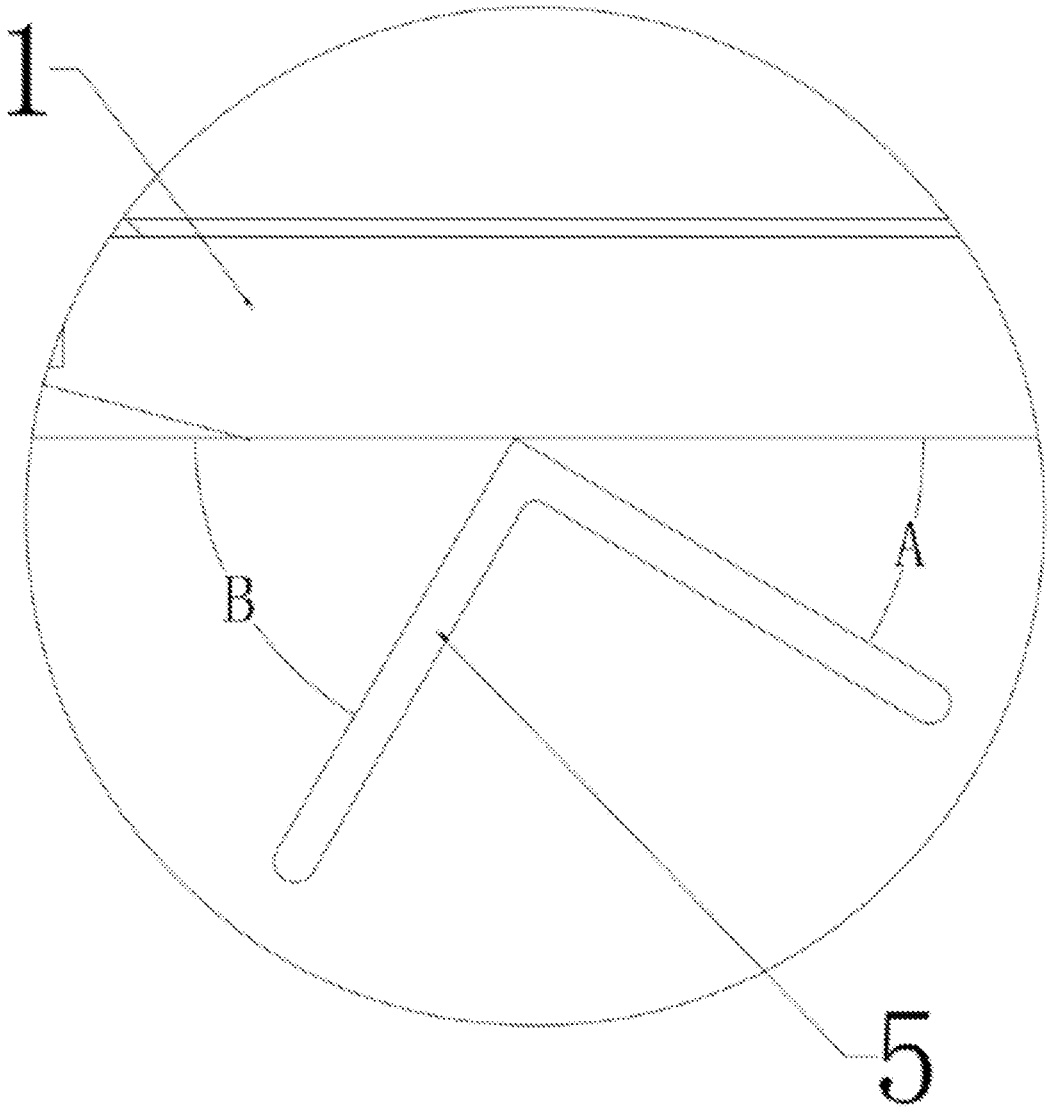
FIG. 2 is an enlarged view of part fin FIG. 1.
Figure 3:
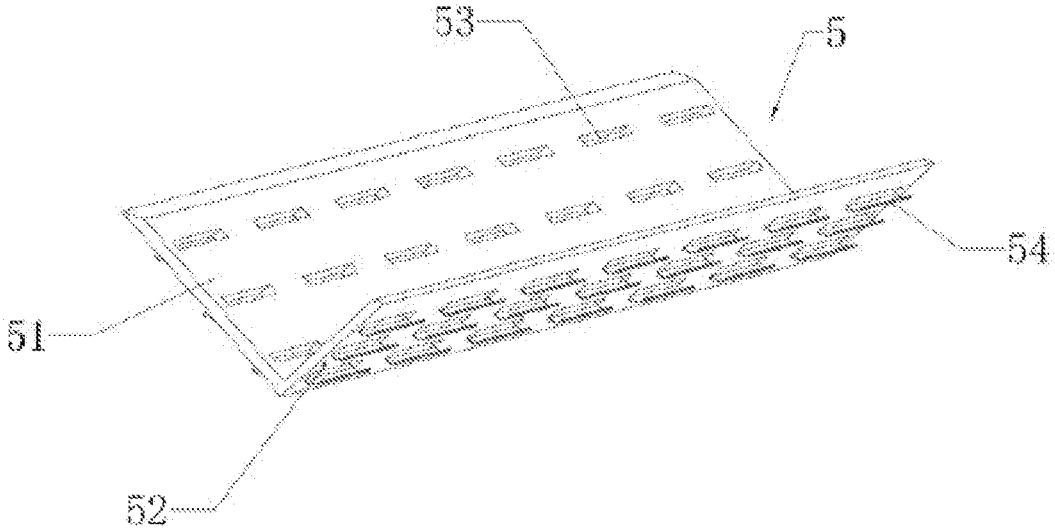
FIG. 3 is a structural schematic diagram of a flow guide plate.

Referring to FIGS. 1-3, in this embodiment, a double-sided uniform air discharge ceiling cassette comprises a case 1, a centrifugal fan wheel 4, a first heat exchanger 2 and a second heat exchanger 3. The centrifugal fan wheel 4, the first heat exchanger 2 and the second heat exchanger 3 are all mounted within the case 1. The first heat exchanger 2 and the second heat exchanger 3 are respectively arranged on two sides of an inner cavity of the case 1, such that the first heat exchanger 2 and the second heat exchanger 3 respectively form an air discharge duct 11 with two inner side walls of the case 1. The centrifugal fan wheel 4 is located between the first heat exchanger 2 and the second heat exchanger 3. An air outlet of the centrifugal fan wheel 4 faces an inner top face of the case 1, such that air blown out by the centrifugal fan wheel 4 flows toward two sides in the case 1, and exchanges heat with the first heat exchanger 2 and the second heat exchanger 3 respectively. The air flow subjected to the heat exchange is blown out from the two air discharge ducts 11.

In this embodiment, the inner top face of the case 1 is provided with a flow guide plate 5. The flow guide plate 5 is of a V-shaped structure with an included angle, and the included angle of the flow guide plate 5 faces the air outlet of the centrifugal fan wheel 4. The air flow blown out by the centrifugal fan wheel 4 is guided by the flow guide plate 5, such that the air discharge volumes from the two sides both account for about 50%, and the air flow distribution is more uniform.

In this embodiment, the included angle of the flow guide plate 5 is 80° to 100°. A length direction of the flow guide plate 5 is arranged inclined to an axial direction of the centrifugal fan wheel 4 on a horizontal plane based on the inner top face of the case 1. An included angle between the length direction of the flow guide plate 5 and the axial direction of the centrifugal fan wheel 4 is 5° to 20°.

In this embodiment, the flow guide plate 5 is composed of a first flow guide portion 51 and a second flow guide portion 52 that are arranged in a V shape, the first flow guide portion 51 and the second flow guide portion 52 being respectively adjacent to the first heat exchanger 2 and the second heat exchanger 3, wherein an included angle A is formed between the first flow guide portion 51 and the inner top face of the case 1, an included angle B is formed between the second flow guide portion 52 and the inner top face of the case 1, and the included angle A and the included angle B are sized in direct proportion to distances from the air outlet of the centrifugal fan wheel 4 to the first heat exchanger 2 and the second heat exchanger 3. That is, the distance between the first heat exchanger 2 and the second heat exchanger 3 is fixed and the included angle A and the included angle B are complementary. The included angle A and the included angle B are adjusted correspondingly according to the mounting position of the air outlet of the centrifugal fan wheel 4. When the distance between the air outlet of the centrifugal fan wheel 4 and the first heat exchanger 2 increases, the included angle A increases. At this time, the distance between the air outlet of the centrifugal fan wheel 4 and the second heat exchanger 3 decreases, and the included angle B decreases. On the contrary, when the distance between the air outlet of the centrifugal fan wheel 4 and the first heat exchanger 2 decreases, the included angle A decreases. At this time, the distance between the air outlet of the centrifugal fan wheel 4 and the second heat exchanger 3 increases, and the included angle B increases. Therefore, firstly, the position of the flow guide plate 5 is rationally adjusted according to the position of the air outlet of the centrifugal fan wheel 4 such that the included angle of the flow guide plate 5 faces the air outlet of the centrifugal fan wheel 4, and secondly, the sizes of the included angle A and the included angle B are adjusted correspondingly according to the distances from the air outlet of the centrifugal fan wheel 4 to the first heat exchanger 2 and the second heat exchanger 3.

Further, the numerical matching relationship between the included angle A and the included angle B and the distances can be adaptively set according to factors such as the specifications of different products, the size of the air volume, and will not be limited here.

In this embodiment, the first flow guide portion 51 and the second flow guide portion 52 have the same width.

In this embodiment, a plate surface of the flow guide plate 5 is provided with a number of uniformly arranged flow guide holes 53, so that the provision of the flow guide holes 53 makes the flow of the air flow more uniform, reducing the loss caused by the dynamic and static pressures at the air outlet of the centrifugal fan wheel 4, and increasing the volume of air discharged. Each of the flow guide holes 53 is in the shape of an elongated hole. A flow guide portion 54 is formed at an outer edge of each of the flow guide holes 53, and the flow guide portion 54 is of a flange structure extending outwardly in an arc shape. An opening between the flow guide portion 54 and the outer edge of the flow guide hole 53 may be arranged upward or downward.

Further, the number and arrangement of the flow guide holes 53 may be determined according to actual product conditions, and will not be limited here.

The above-described embodiments are only preferred embodiments of the present application, and are not intended to limit the present application in any form. More possible alterations and modifications or changes made by any person skilled in the art to the technical solution of the present application by using the technical content disclosed above without departing from the scope of the technical solution of the present application are all equivalent embodiments of the present application. Therefore, without departing from the content of the technical solution of the present application, equivalent changes made according to the idea of the present application shall all be included in the scope of protection of the present application.

What is claimed is:

1. A double-sided uniform air discharge ceiling cassette, comprising a case (1), and a centrifugal fan wheel (4), a first heat exchanger (2), and a second heat exchanger (3) which are mounted within the case (1), the first heat exchanger (2) and the second heat exchanger (3) respectively forming an air discharge duct (11) with two inner side walls of the case (1), the centrifugal fan wheel (4) being located between the first heat exchanger (2) and the second heat exchanger (3), and an air outlet of the centrifugal fan wheel (4) facing an inner top face of the case (1), characterized in that the inner top face of the case (1) is provided with a flow guide plate (5), wherein the flow guide plate (5) is of a V-shaped structure with an included angle, and the included angle of the flow guide plate (5) faces the air outlet of the centrifugal fan wheel (4).

2. The double-sided uniform air discharge ceiling cassette according to claim 1, characterized in that a length direction of the flow guide plate (5) is arranged inclined to an axial direction of the centrifugal fan wheel (4) on a horizontal plane based on the inner top face of the case (1).

3. The double-sided uniform air discharge ceiling cassette according to claim 1, characterized in that an included angle between a length direction of the flow guide plate (5) and an axial direction of the centrifugal fan wheel (4) is 5° to 20°.

4. The double-sided uniform air discharge ceiling cassette according to claim 1, characterized in that the included angle of the flow guide plate (5) is 80° to 100°.

5. The double-sided uniform air discharge ceiling cassette according to claim 1, characterized in that the flow guide plate (5) is composed of a first flow guide portion (51) and a second flow guide portion (52) that are arranged in a V shape, the first flow guide portion (51) and the second flow guide portion (52) being respectively adjacent to the first heat exchanger (2) and the second heat exchanger (3), wherein an included angle A is formed between the first flow guide portion (51) and the inner top face of the case (1), an included angle B is formed between the second flow guide portion (52) and the inner top face of the case (1), and the included angle A and the included angle B are sized in direct proportion to distances from the air outlet of the centrifugal fan wheel (4) to the first heat exchanger (2) and the second heat exchanger (3).

6. The double-sided uniform air discharge ceiling cassette according to claim 5, characterized in that the first flow guide portion (51) and the second flow guide portion (52) have the same width.

7. The double-sided uniform air discharge ceiling cassette according to claim 1, characterized in that a plate surface of the flow guide plate (5) is provided with a number of uniformly arranged flow guide holes (53).

8. The double-sided uniform air discharge ceiling cassette according to claim 7, characterized in that a flow guide portion (54) is formed at an outer edge of each of the flow guide holes (53), and the flow guide portion (54) is of a flange structure extending outwardly in an arc shape.

9. The double-sided uniform air discharge ceiling cassette according to claim 7, characterized in that each of the flow guide holes (53) is in the shape of an elongated hole.

10. The double-sided uniform air discharge ceiling cassette according to claim 8, characterized in that an opening between the flow guide portion (54) and the outer edge of the flow guide hole (53) is capable of being arranged upward or downward.

* * * * *